US005653484A

United States Patent [19]

Brackmann et al.

[11] Patent Number: 5,653,484

[45] Date of Patent: Aug. 5, 1997

[54] MOTOR-VEHICLE DOOR LATCH

[75] Inventors: Horst Brackmann, Velbert; Rainer Kipka, Essen, both of Germany

[73] Assignee: Kiekert AG, Heiligenhaus, Germany

[21] Appl. No.: 647,440

[22] Filed: May 7, 1996

[30] Foreign Application Priority Data

May 9, 1995 [DE] Germany ..... 295 07 642.9

[51] Int. Cl.[6] ..... E05L 3/06

[52] U.S. Cl. ..... 292/216; 292/DIG. 23; 292/DIG. 27

[58] Field of Search ..... 70/262, 237, DIG. 9; 292/216, DIG. 23, DIG. 27

[56] References Cited

U.S. PATENT DOCUMENTS

| | | | |
|---|---|---|---|
| 3,121,580 | 2/1964 | Di Salvo et al. | 292/DIG. 27 |
| 4,005,887 | 2/1977 | Itakura | 292/216 |
| 4,904,006 | 2/1990 | Hayakawa et al. | 292/336.3 |
| 4,995,653 | 2/1991 | Torii | 292/216 |
| 4,995,654 | 2/1991 | Nishigami et al. | 292/216 |
| 5,154,460 | 10/1992 | Bartsch | 292/336.3 |
| 5,308,128 | 5/1994 | Portelli et al. | 292/216 |
| 5,454,608 | 10/1995 | Dzurko et al. | 292/216 |

FOREIGN PATENT DOCUMENTS 4433994 3/1996 Germany .

*Primary Examiner*—Steven N. Meyers
*Assistant Examiner*—Donald J. Lecher
*Attorney, Agent, or Firm*—Herbert Dubno; Andrew Wilford

[57] ABSTRACT

A motor-vehicle door latch has a pivotal latching fork, a release pawl engageable with the fork and displaceable between latched and unlatched positions, and a release lever engageable with the pawl for displacing same between its positions and formed with an elongated slot. An outside actuating lever is provided with an entrainment nose aligned with an end of the release-lever slot. Separate inside and outside locking levers are coupled via a spring to a main locking lever displaceable by the inside and outside levers between a locked and an unlocked position. A link lever pivoted on the main locking lever carries a coupling pin projecting through the slot and engageable with the entrainment nose in the unlocked position of the main locking lever and unengageable with the entrainment nose in the locked position of the main locking lever. The link lever is slidably mounted on the main locking lever and is biased toward the entrainment nose so that on movement of the main locking lever from the locked to the unlocked position with the actuating lever actuated the coupling pin engages the nose and the link lever slides against spring force on the main locking lever. An antitheft lever displaceable between on and off positions is operatively engageable in the on position with the main locking lever to retain the main locking lever in the locked position and prevent it from moving into the unlocked position.

6 Claims, 4 Drawing Sheets

MOTOR-VEHICLE DOOR LATCH

FIELD OF THE INVENTION

The present invention relates to a motor-vehicle door latch. More particularly this invention concerns such a latch provided with an antitheft mechanism.

BACKGROUND OF THE INVENTION

A standard motor-vehicle door latch has a pivotal latching fork, a release pawl engageable with the fork and displaceable between a latched position retaining the fork in a latched position engaged around a bolt and securing a motor-vehicle door closed and an unlatched position in which the fork can release the bolt and allow the door to open, and a release lever engageable with the pawl for displacing it between its positions and formed with an elongated slot. An outside actuating lever is provided with an entrainment nose aligned with an end of the release-lever slot. Separate inside and outside locking levers are coupled to a main locking lever displaceable thereby between a locked and an unlocked position. A link lever pivoted on the main locking lever carries a coupling pin projecting through the slot and engageable with the entrainment nose on pivoting of the main locking lever into the unlocked position of the main locking fever and unengageable on pivoting of the main locking lever with the entrainment nose into the locked position of the main locking lever. An antitheft lever displaceable between on and off positions is operatively engageable in the on position with the main locking lever to retain it in the locked position.

Normally the outside actuating lever is connected to the outside door handle and the inside actuating lever with the inside door handle. The outside locking lever is operated by a lock cylinder on the door and the inside locking lever is connected to an inside knob or element. With this system the outside actuating lever as well as the link lever decouple the actuating-lever system from the release lever in the locked position of the latch. Thus when locked the outside actuating lever can move but does nothing. The antitheft lever ensures when in the on position that when the door is locked it cannot even be opened by the inside handle.

Such a lock is described in German patent document 4,433,994 of Kleefeldt. The antitheft arrangement can move freely since the link lever is slidable on the main locking lever and is urged by a spring into the unlocked position. In the on position of the antitheft system a blocking formation is in the path of the link lever so that it cannot assume the unlocked position. In other words the movement of the antitheft system is defined by the link lever and the main locking lever.

In another known system the movement of the antitheft system is defined by the inside locking lever and the main locking lever. In this arrangement the link lever is no longer slidable on the main locking lever for the antitheft operation. This arrangement is advantageous but does not always function perfectly. If an attempt is made to move the latch out of the locked or antitheft position by means of the outside actuating lever, the coupling pin of the link lever engages laterally against the entrainment nose of the outside actuating lever and prevents the main locking lever from being fully moved in to the unlocked position. This blocks up the latch mechanism and, if too much force is applied to the handle, could damage it.

OBJECTS OF THE INVENTION

It is therefore an object of the present invention to provide an improved motor-vehicle door latch.

Another object is the provision of such an improved motor-vehicle door latch which overcomes the above-given disadvantages, that is which does not have a free running antitheft function between the link lever and the main locking lever and wherein the latch thus always functions properly.

SUMMARY OF THE INVENTION

A motor-vehicle door latch has according to the invention a pivotal latching fork, a release pawl engageable with the fork and displaceable between a latched position retaining the fork in a latched position engaged around a bolt and securing a motor-vehicle door closed and an unlatched position in which the fork can release the bolt and allow the door to open, and a release lever engageable with the pawl for displacing same between its positions and formed with an elongated slot. An outside actuating lever is provided with an entrainment nose aligned with an end of the release-lever slot. Separate inside and outside locking levers are coupled via a spring to a main locking lever displaceable by the inside and outside levers between a locked and an unlocked position. A link lever pivoted on the main locking lever carries a coupling pin projecting through the slot and engageable with the entrainment nose in the unlocked position of the main locking lever and unengageable with the entrainment nose in the locked position of the main locking lever. The link lever is slidably mounted on the main locking lever and is biased toward the entrainment nose so that on movement of the main locking lever from the locked to the unlocked position with the actuating lever actuated the coupling pin engages the nose and the link lever slides against spring force on the main locking lever. An antitheft lever displaceable between on and off positions is operatively engageable in the on position with the main locking lever to retain the main locking lever in the locked position and prevent it from moving into the unlocked position.

Since the link lever is slidable on the main locking lever and is biased into its end position, the main locking lever can be swung into the unlocked position even when the outer actuating lever is actuated. It is understood that the coupling lever is urged into the unlocked position. Once the actuated outside actuating handle is released, the coupling lever snaps again into its normal position and when the outside actuating lever is again actuated it will work normally.

According to the invention the link lever is movable generally parallel, that is at less than a 45° angle, to the slot. The link lever is biased by a spring urging the link lever toward the entrainment nose. Another spring links the inside locking lever with the main locking lever. The springs are of such relative stiffnesses that in the unlocked and on positions the link lever on actuation of the inside locking lever does not move.

In addition according to the invention an inside actuating lever has an entrainment nose aligned with the entrainment nose of the outside actuating lever. The two noses are generally aligned so that either of them can unlock the door in the coupling position of the link lever.

The latch according to the invention can also have a remotely operated drive connected to one of the link and antitheft levers for actuating same.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
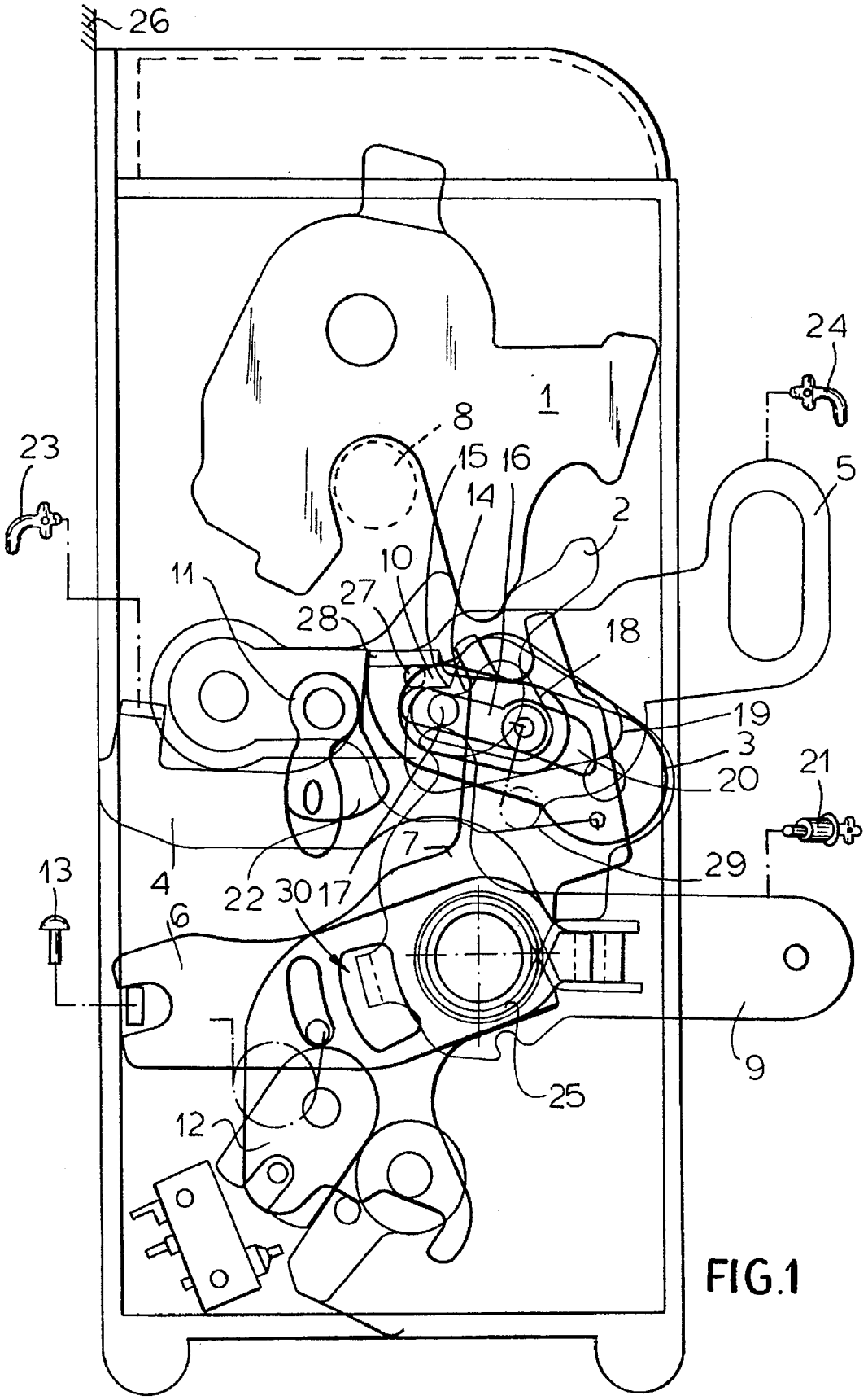
FIG. 1 is a partly diagrammatic side view of the latch according to the invention.

As seen in FIG. 1 a motor-vehicle door latch according to the invention is mounted in a door shown schematically at 26 and has a standard pivotal lock fork 1 engageable around a post-mounted bolt shown in dashed lines at 8. The latch has a conventional pawl 2 that can hold the fork 1 in the illustrated retaining position and from which extends a pin 27 that can be actuated by a bent-over tab 28 of a pivotal release lever 3 to release the fork 1 and allow the bolt 8 to be withdrawn from the latch. The release lever 3 in turn is operated via a link assembly 10, 17 described below by an inside actuating lever 4 connected to an inside door handle 23 and by an outside actuating lever 5 connected to an outside door handle 24. The inside and outside actuating levers 4 and 5 have respective throughgoing cutouts 18 and 19 provided with respective entrainment formations or noses 14 and 15. The release lever 3 is formed with a slot 16 extending longitudinally of itself. The noses 14 and 15 are aligned with one end of the slot 16.

A locking-lever system has a main locking lever 7 connected via a torque-spring linkage 25 to and operable by an inside locking lever 6 connected to an inside locking element or button 13. In turn the inside locking lever 6 is operable through a lost-motion coupling 30 by an outside locking lever 9 connected to a key-cylinder 21 accessible from outside the door 26.

Figure 2:
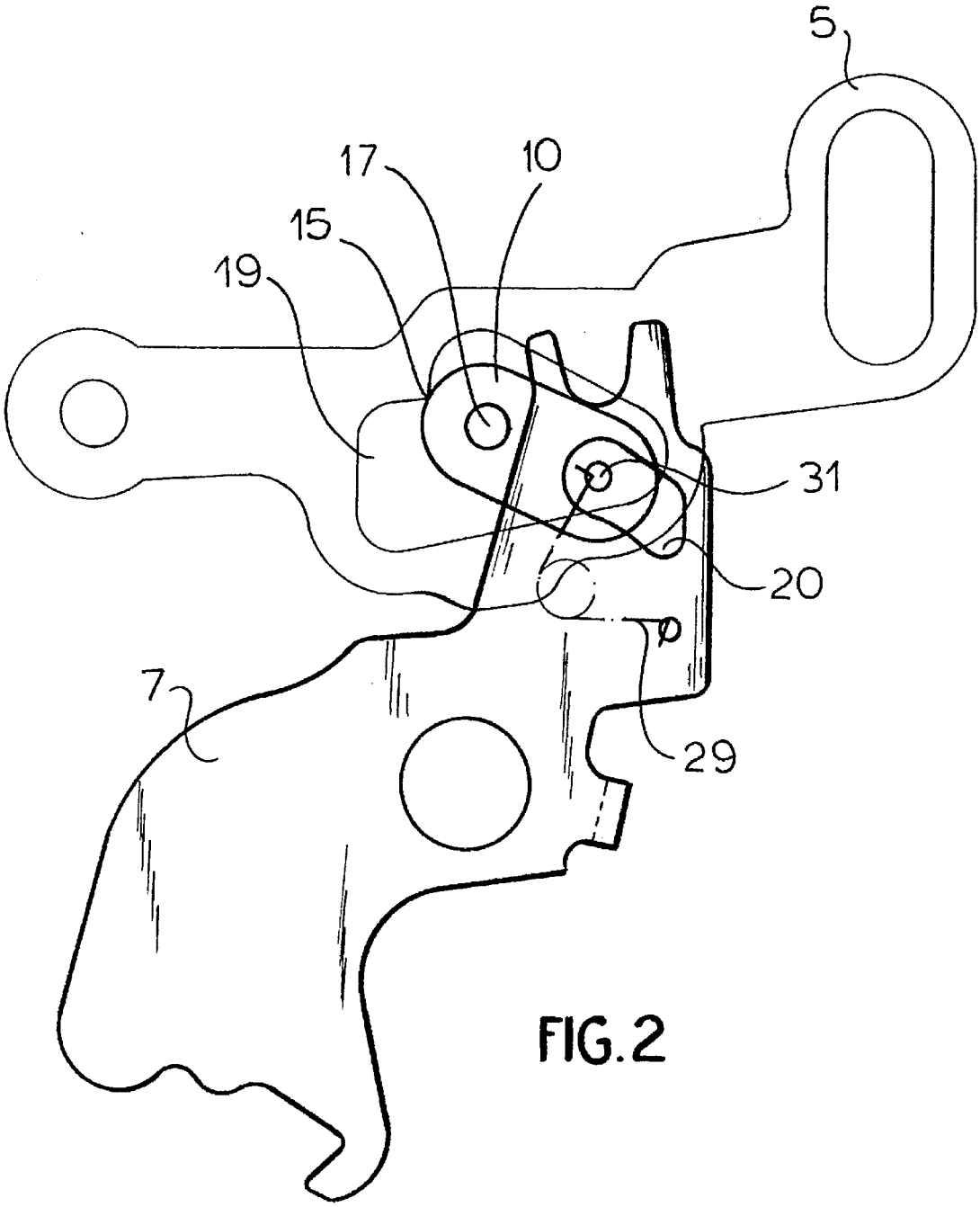
FIG. 2 is a view of a detail of the invention in the locked position.
Figure 3:
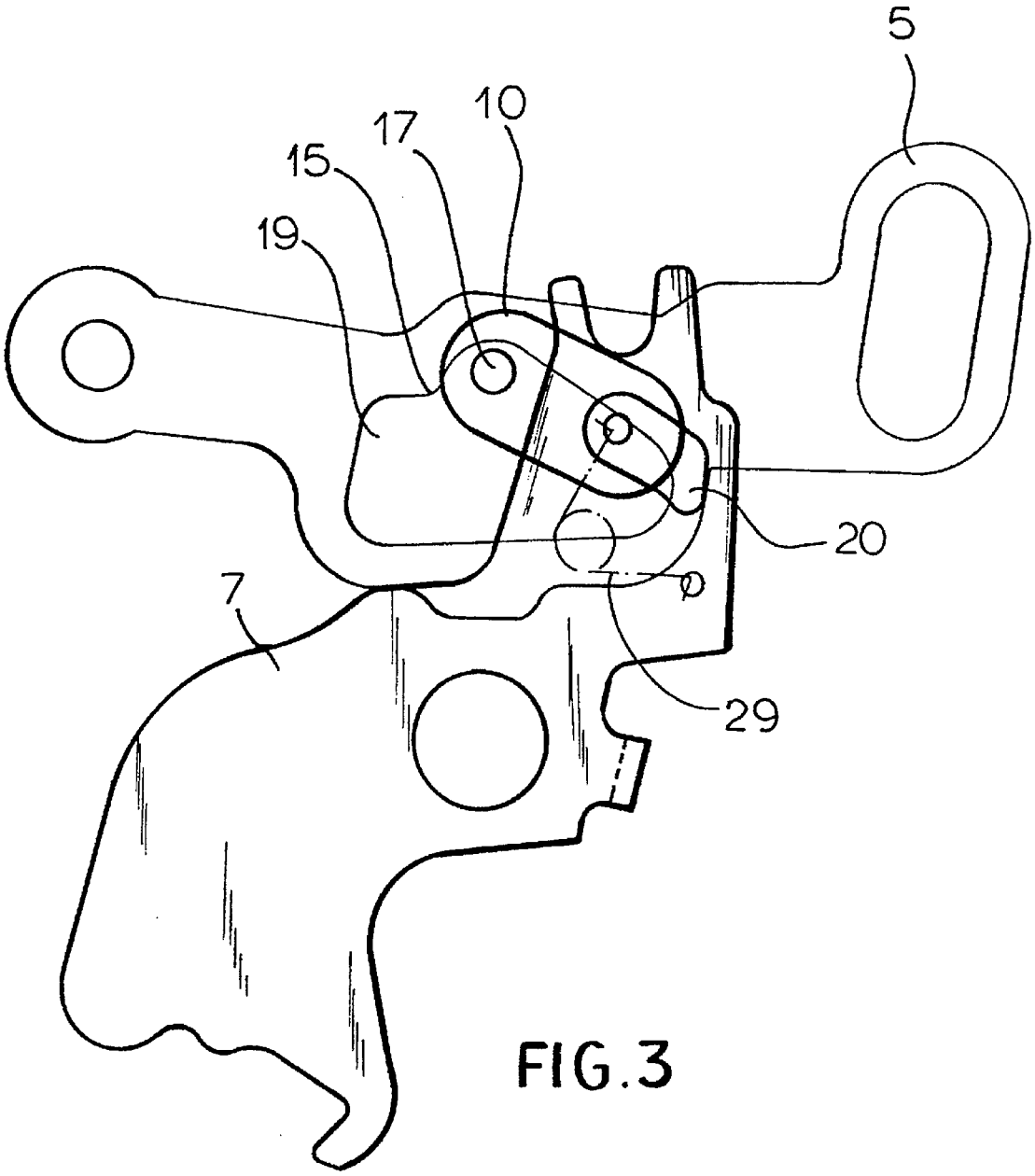
FIG. 3 is a view like FIG. 2 but in the locked and actuated position.
Figure 4:
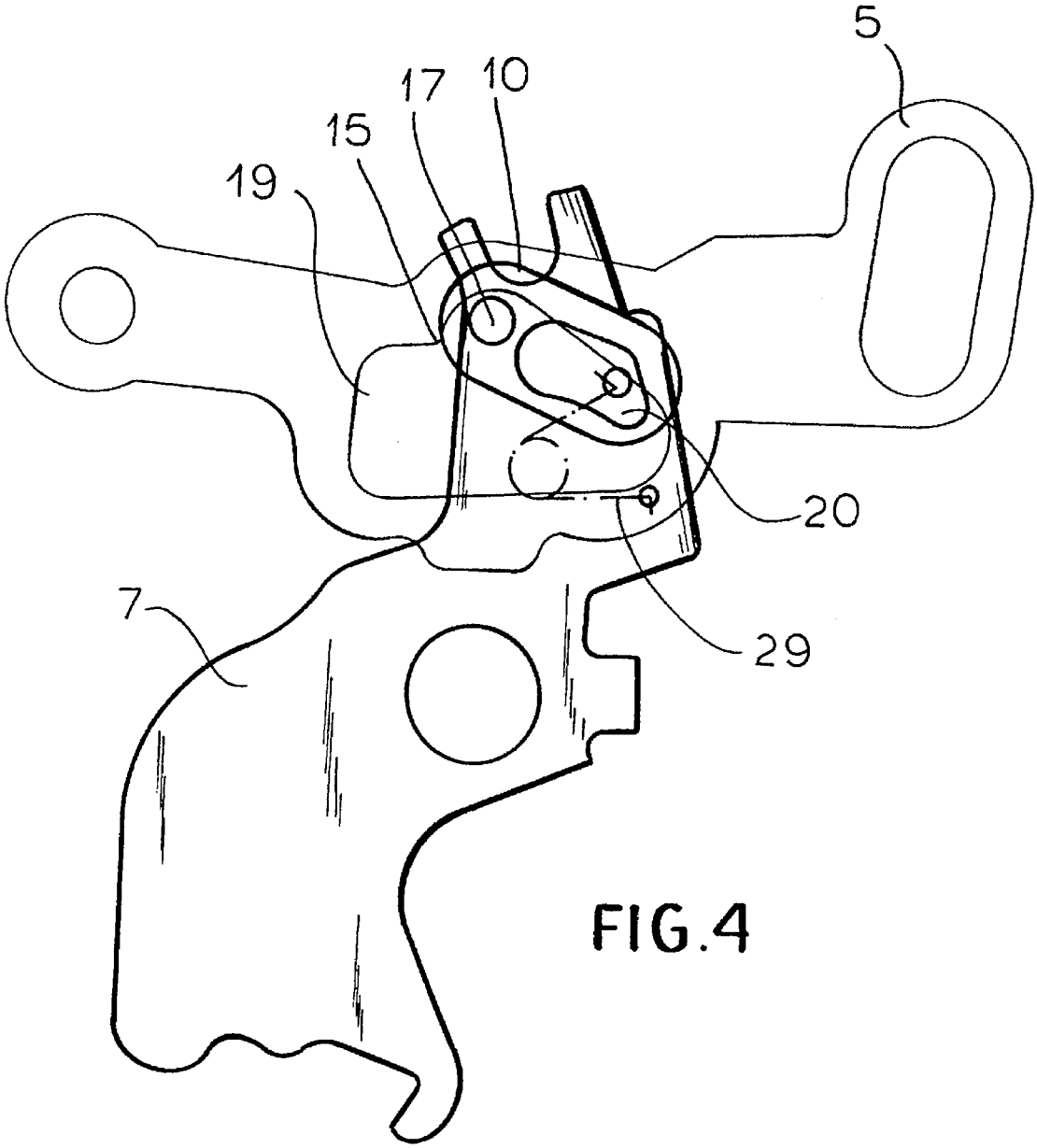
FIG. 4 is another view like FIG. 2 but in the unlocked position with an actuated main locking lever.

As also partially shown in FIGS. 2 through 4 a link lever 10 with a coupling pin 17 is mounted via a sliding pivot 31 on the main locking lever 7 with this pin 17 extending through the two cutouts 18 and 19 as well as through the slot 16. When the pin 17 is in the unlocked position (toward the left in FIG. 1) it couples the levers 4 and 5 to the lever 3 so that actuation of either lever moves the pin 17 down, thereby pivoting down the tab 28 of the lever 3 to engage the pin 27 of the pawl 2 and thereby open the latch. When the pin 17 is in the opposite end or locked position (toward the right as seen in FIG. 1) as the levers 4 and 5 are actuated the pin 17 will stay stationary in the larger right-hand ends of their cutouts 18 and 19, that is past the entrainment noses 14 and 15, decoupling the levers 4 and 5 from the lever 3 so that their actuation does not unlatch the door 26. Attention is directed here to FIG. 1 of above-cited German 4,433,944 which shows a nearly identical system.

There is also an antitheft lever 11 by means of which an antitheft-on position can be set in which displacement of the link lever 10 and the main locking lever 7 into the unlocked position is blocked. To this end the antitheft lever 11 has a blocking cam formation 22 which can be swung into the path of the coupling pin 17 to prevent movement of the link lever 10 from the right-hand locked position. In the antitheft position the inside locking lever 6 is thus decoupled from the main locking lever 7 so that even if it is actuated it does nothing. A central drive or actuator is provided with an output element 12 by means of which the main locking lever 7 and/or the antitheft lever 11 can be pivoted between their end positions.

When the latch is unlocked and the outside actuating lever 5 is operated the link lever 10 moves against spring force relative to the main locking lever 7. The same happens when the latch is unlocked and the inside lever 4 is operated. The pivot 31 of the link lever 10 is slidable along a slot 20 extending parallel to the release-lever slot 16 and is acted on by a prestressing spring 29 urging it toward the entrainment nose 14 and 15 of the lever 4 and 5, that is into the coupling position in which it couples these levers 4 and 5 to the lever 3.

FIGS. 2 and 3 show how the outside actuating lever 5 in the locked position of the latch is decoupled since its entrainment nose 15 is out of the path of the pin 17 on actuation of the outside actuating lever 5. FIG. 2 shows the lever 5 in the rest position and FIG. 3 in the actuated position, it being understood that the effect is the same for the lever 4. On the other hand, in the position of FIG. 1 an actuation of the outside actuating lever 5 causes the engagement nose 15 to entrain the coupling pin 17 and thus pull down the lever 3 and release the pawl 2.

FIGS. 3 and 4 show how even when the outside actuating lever 5 is actuated in the unlocked position of the latch the main locking lever 7 can pivot. This is possible because the link lever 10 is pivoted against spring force relative to the main locking lever 7 during pivoting of the main locking lever. The lateral deflection of the coupling pin 17 against the entrainment nose is compensated for by a prestressing spring 29. Once the outside actuating lever 5 is released the mechanism returns to the FIG. 1 position.

We claim:

1. A motor-vehicle door latch comprising:

a pivotal latching fork;

a release pawl engageable with the fork and displaceable between a latched position retaining the fork in a latched position engaged around a bolt and securing a motor-vehicle door closed and an unlatched position in which the fork can release the bolt and allow the door to open;

a release lever engageable with the pawl for displacing same between its positions and formed with an elongated slot;

an outside actuating lever provided with an entrainment nose aligned with an end of the release-lever slot;

separate inside and outside locking levers;

a main locking lever coupled to the inside and outside locking levers and displaceable thereby between a locked and an unlocked position;

a link lever pivoted on the main locking lever and carrying a coupling pin projecting through the slot and engageable with the entrainment nose in the unlocked position of the main locking lever and unengageable with the entrainment nose in the locked position of the main locking lever;

biasing means slidably mounting the link lever on the main locking lever for urging the link lever toward the entrainment nose, whereby on movement of the main locking lever from the locked to the unlocked position with the actuating lever actuated the coupling pin engages the nose and the link lever slides against spring force on the main locking lever; and an antitheft lever displaceable between on and off positions and operatively engageable in the on position with the main locking lever to retain the main locking lever in the locked position and prevent it from moving into the unlocked position.

2. The motor-vehicle door latch defined in claim 1 wherein the link lever is movable generally parallel to the slot, the biasing means including a spring urging the link lever toward the entrainment nose.

3. The motor-vehicle door latch defined in claim 2, further comprising a spring linking the inside locking lever with the main locking lever.

4. The motor-vehicle door latch defined in claim 3 wherein the springs are of such relative stiffnesses that in the unlocked and on positions the link lever on actuation of the inside locking lever does not move.

5. The motor-vehicle door latch defined in claim 1, further comprising an inside actuating lever having an entrainment nose aligned with the entrainment nose of the outside actuating lever.

6. The motor-vehicle door latch defined in claim 1, further comprising a remotely operated drive connected to one of the link and antitheft levers for actuating same.

* * * * *